US006575074B1

(12) United States Patent
Gaddini

(10) Patent No.: US 6,575,074 B1
(45) Date of Patent: Jun. 10, 2003

(54) OMEGA FIREARMS SUPPRESSOR

(75) Inventor: Joseph Daniel Gaddini, Augusta, GA (US)

(73) Assignee: Joseph D. Gaddini, Evans, GA (US)

( * ) Notice: Subject to any disclaimer, the term of this patent is extended or adjusted under 35 U.S.C. 154(b) by 0 days.

(21) Appl. No.: 10/202,110

(22) Filed: Jul. 23, 2002

(51) Int. Cl.[7] ..... F41A 21/00
(52) U.S. Cl. ..... 89/14.4
(58) Field of Search ..... 89/14.4; 181/223

(56) References Cited

U.S. PATENT DOCUMENTS

| | | | | | |
|---|---|---|---|---|---|
| 944,646 | A | | 12/1909 | Xardell | |
| 2,008,964 | A | | 7/1935 | Mikulic | |
| 3,385,164 | A | * | 5/1968 | Walther et al. | 89/14.4 |
| 4,291,610 | A | * | 9/1981 | Waiser | 89/14.4 |
| 4,576,083 | A | | 3/1986 | Seberger, Jr. | |
| 4,588,043 | A | * | 5/1986 | Finn | 181/223 |
| 4,907,488 | A | * | 3/1990 | Seberger | 89/14.4 |
| 4,974,489 | A | * | 12/1990 | Fishbaugh | 89/14.4 |
| 5,164,535 | A | | 11/1992 | Leasure | |
| 5,679,916 | A | * | 10/1997 | Weichert | 89/14.4 |
| 6,374,718 | B1 | * | 4/2002 | Rescigno et al. | 89/14.4 |

* cited by examiner

*Primary Examiner*—Charles T. Jordan
*Assistant Examiner*—Jordan M Lofdahl

(57) ABSTRACT

A sound suppressor for a firearm comprises a cylindrical housing having a rear end cap attached to the housing and having means for mounting to the muzzle of a firearm, a front end cap attached to the housing and having a centrally positioned aperture, and at least one baffle element positioned within the housing between the rear end cap and front end cap. The baffle element comprises a flat plate with an integral rearward-protruding cone with the cone having an entrance aperture and an exit aperture, with the cone having an elongated aperture that extends from the entrance aperture toward the flat plate. An initial coaxial spacer element is positioned between the rear end cap and the baffle element, with the initial coaxial spacer element having at least one gas port and at least one notch at an edge of the initial coaxial spacer element. Inner and outer expansion chambers are formed between the rear end cap, the initial coaxial spacer element and the baffle element. A coaxial spacer element is positioned between the front end cap and the baffle element, and the coaxial spacer element has at least one gas port and at least one notch at an edge of the coaxial spacer element. Inner and outer expansion chambers are formed between the baffle element, the coaxial spacer element and the front end cap.

14 Claims, 3 Drawing Sheets

OMEGA FIREARMS SUPPRESSOR

BACKGROUND OF THE INVENTION

1. Field of the Invention

The Invention relates in general to a sound suppressor device for reducing the muzzle blast and muzzle flash that occurs during the firing of a firearm, and in particular, to such a device comprised of a type including an outer tube housing having baffles and reduced diameter coaxial spacers mounted therein.

2. Description of the Prior Art

A number of sound suppressor devices currently exist which use baffles and reduced diameter coaxial spacers mounted in outer tube housings, but many of these suppressor devices do not achieve high levels of noise and flash attenuation. A common occurrence with many of these devices, regardless of the baffle technology used, is that they have a detrimental effect on the accuracy of the host firearm when attached to said firearm, whereby the point of impact of the projectile fired is significantly different from the point of aim of the projectile. This detrimental effect on accuracy means that the shooter has to significantly adjust the sights on the host firearm to compensate for the detrimental effect on accuracy when shooting with the sound suppressor device attached to the host firearm. This is standard practice when using sound suppressors on high-powered rifles such as 5.56 mm and 7.62 mm rifles.

Another difficulty with many prior art sound suppressor devices is that they work well with only one caliber of ammunition. As an example, one type of sound suppressor device may work well with 9 mm caliber ammunition, but it will not work well with 7.62 mm NATO caliber ammunition. The gas pressure levels of these examples of ammunition are quite different, and this affects the performance of the sound suppressor device. This has meant that a particular baffle and spacer design has to be, in some cases, extensively modified so that good performance is achieved with different caliber firearms.

Prior art sound suppressor devices have also employed the addition of a liquid or oil or grease or fluid-like material to enhance the sound reduction. Depending upon the caliber and type of firearm used, an extra 5 to 15 dB of sound reduction is achieved through the use of fluid additives with a sound suppressor. This results in a suppressor with very high sound reduction levels, albeit dependent upon the use of the fluid additive to achieve these very high sound reduction levels. Drawbacks of the use of such materials, especially oil or greases, is that a visible gas or smoke exits from the suppressor and that to maintain the extra levels of sound reduction achieved by the addition of liquids or fluid-like materials, the user is required to place or inject the material into the suppressor once sound reduction levels decrease. Instead of using oil or grease, current practice is to use a small amount of water, and this has the effect of minimizing the visible gas exiting from the suppressor after firing. Depending upon the caliber, the suppressor may require the injection or placement of the material after as few as 5 to 10 shots have been fired through the suppressor.

It is an object of this invention to provide a firearms sound suppressor device that produces high levels of sound and flash reduction while generating little or no significant detrimental deviation of the strike of the projectile, and at the same time utilizing a baffle and coaxial spacer design that produces high levels of sound and flash reduction with different calibers of ammunition without requiring significant modification of the baffle and spacer design. It is also an object of this invention to provide a firearms sound suppressor device that is tuned to provide high levels of sound and flash reduction in which the same baffle is utilized in different caliber suppressors while only slight variations of the coaxial spacer design are required to achieve the tuning of the suppressor to the particular caliber being used. It is also an object of this invention to provide a firearms sound suppressor that produces very high levels of sound reduction without the use of fluid additives.

BRIEF SUMMARY OF THE INVENTION

According to the disclosed invention, a firearms sound suppressor device comprises an outer tube housing that has at least one baffle and a coaxial spacer element and an initial coaxial spacer element mounted thereon, the baffle consisting of a flat plate with an integral rearward protruding cone with said cone having an internal conical surface having an opening on the front face of said flat plate, with said conical surface having an elongated gas aperture whereby a portion of said conical surface is cut away at the bore hole of the baffle, and the initial coaxial spacer consisting of a spacer that has at least one notch at one edge of the spacer and at least one gas port in the body of the spacer. The initial coaxial spacer element is positioned between a rear end cap and said baffle and coaxial spacer element, and the initial coaxial spacer element has at least one notch at one edge of the spacer and at least one gas port in the body of the spacer.

In a preferred embodiment, the sound suppressor utilizes an outer tube or housing, a rear end cap secured to the outer tube which is threaded internally for attaching to a firearm, a plurality of baffles and spacers positioned within the housing, and a front end cap secured to the outer tube that has an aperture for projectiles to pass through, and which serves to encapsulate the plurality of baffles and spacers within the outer tube. The placement and orientation of the reduced diameter coaxial spacer elements varies according to the caliber of the host firearm and said spacers may be either integral with the baffle to form a baffle/spacer element or may be a separate tubular element which is then positioned between baffles to form two expansion chambers.

BRIEF DESCRIPTION OF THE DRAWINGS

Referring particularly to the drawings for the purposes of illustration only, and not limitation.

DETAILED DESCRIPTION OF A FIRST EMBODIMENT OF THE INVENTION

Figure 1:
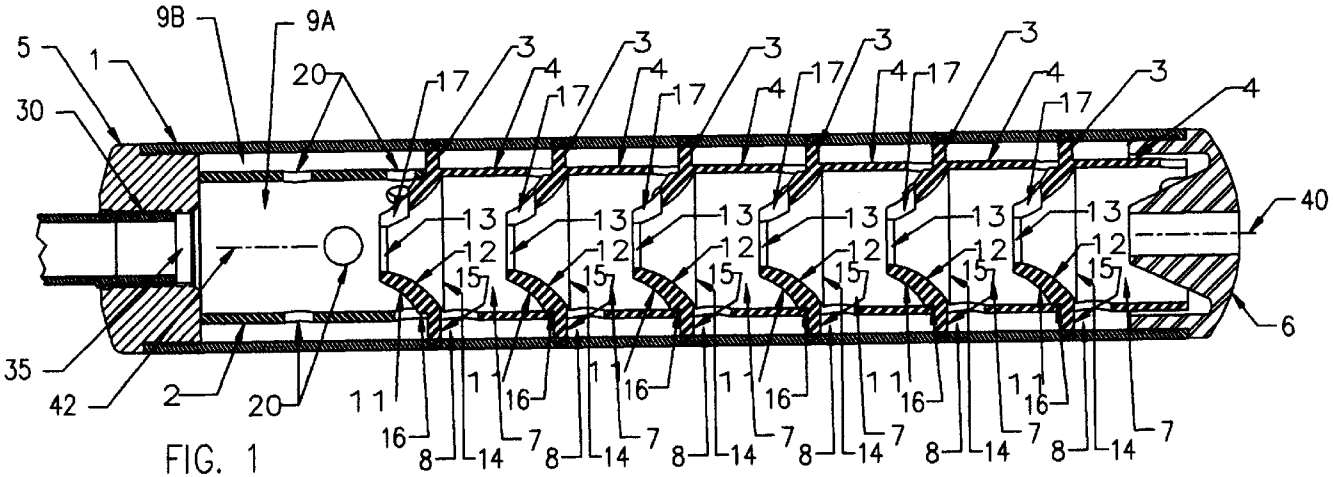
FIG. 1 is a cross-sectional view of the invention showing a firearm sound suppressor mounted on a firearm barrel.

FIG. 1 shows a first embodiment of the sound suppressor that consists of a hollow cylindrical housing 1 with baffle elements 3 and coaxial spacer elements 4 forming a series of expansion chambers 7 and 8 between the baffle elements 3. A rear end cap 5 and a front end cap 6 are secured to the housing 1, either by screw threads which are not shown or by welding the end caps 5 and 6 to the housing 1.

An initial coaxial spacer element 2 is positioned between the rear end cap 5 and a baffle element 3 and this forms two initial gas expansion chambers 9*a* and 9*b*. Baffle element 3 consists of a flat plate 10 with an integral rearward protruding cone 11 with the apex of the conical surface pointing towards the muzzle of the firearm and the cone 11 having an internal conical surface 12 and a bore aperture 13. Cone 11 has an opening 14 on the front face 15 of the baffle element. An annular shoulder 16 is provided to allow for the initial coaxial spacer element 2 and coaxial spacer element 4 to interface with the baffle element 3 and to provide alignment between said initial coaxial spacer element 2.

Figure 2:
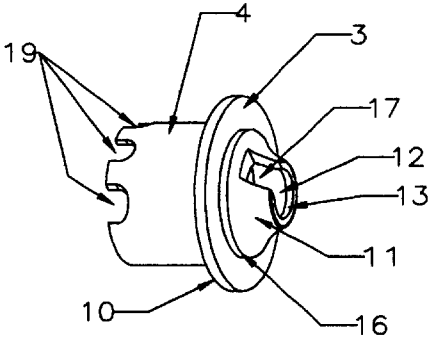
FIG. 2 is a rear face perspective view of a baffle/spacer element that is part of the firearm sound suppressor shown in FIG. 1.

The rearward protruding cone 11 has a bore aperture 13 and bore aperture 13 is provided with an elongated slot 17. Elongated slot 17 is shown in FIG. 2 at approximately the 11 o'clock position for illustrative purposes only. In practice, the position of elongated slot 17 varies according to the caliber of the host firearm and for maximum sound reduction.

Figure 10:
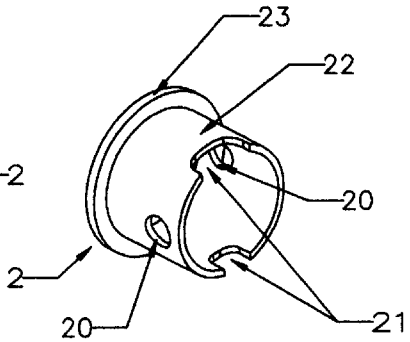
FIG. 10 is a front face perspective view of an alternate initial spacer element of FIG. 9.
Figure 3:
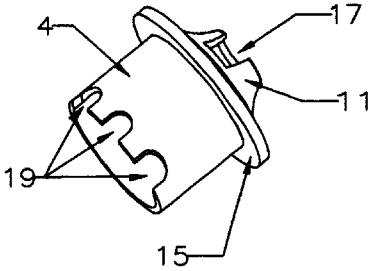
FIG. 3 is a front face perspective view of a baffle/spacer element of FIG. 2.
Figure 9:
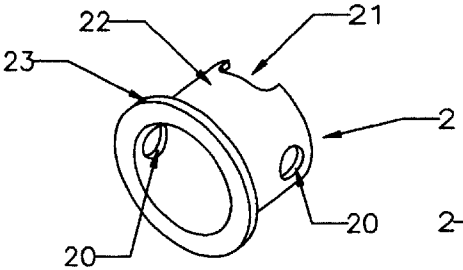
FIG. 9 is a.rear face perspective view of an alternate initial spacer element that is part of the firearm sound suppressor shown of FIG. 6.

Coaxial spacer element 4 may be combined with baffle element 3 as shown in FIG. 2 and FIG. 3 to form a combined baffle/spacer element where the coaxial spacer element 4 is an integral part of the baffle element 3 and protrudes forward from the flat plate 10. FIG. 2 and FIG. 3 show the spacer element 4 as a part of baffle element 3 20 in the body and at least one notch 21 at an edge of the spacer. Although FIG. 9 and FIG. 10 show a plurality of gas ports 20 and a plurality of notches 21, it should be understood that this is shown for illustrative purposes only. In practice, at least one gas port 20 and at least one notch 21 is used. The size of reduced diameter cylindrical shaped tube 22 is less than the internal diameter of housing 1.

Figure 6:
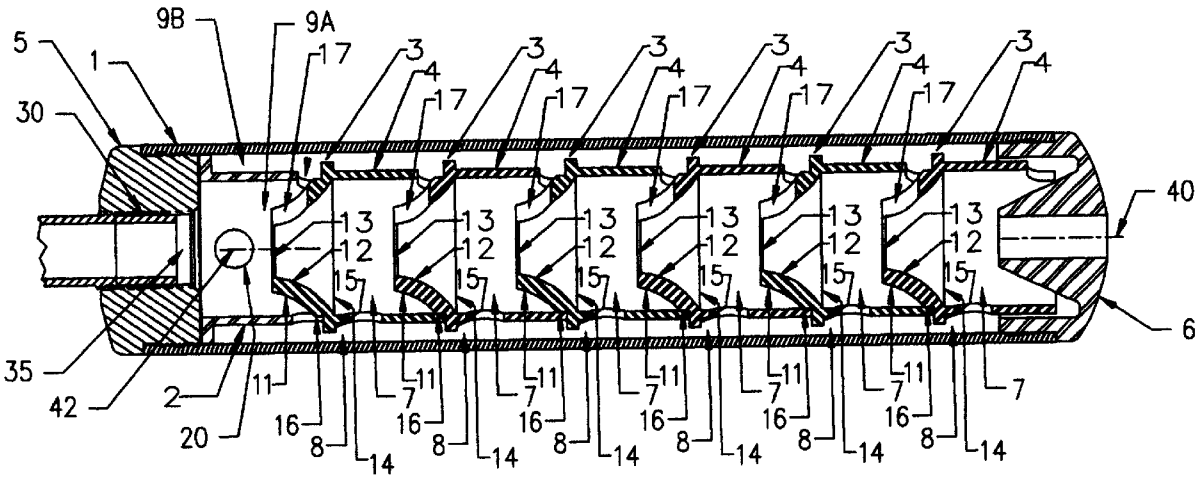
FIG. 6 is a side sectional drawing of the invention showing a firearm sound suppressor mounted on a firearm barrel showing an alternate baffle/spacer element and initial spacer element.

If the baffle 3 and spacer element 4 are integral, the coaxial spacer element fits over annular shoulder 16 of the next baffle element 3 downstream from previous the baffle element 3, thus creating expansion chambers 7 and 8 as shown in FIG. 1 and FIG. 6. If the baffle 3 and spacer element 4 are separate, the coaxial spacer fits over annular shoulder 16 of the next baffle element 3 downstream from the previous baffle element 3 and abuts up against the front face 15 of the previous baffle element 4, creating expansion chambers 7 and 8 in the same manner as in FIG. 1 and FIG. 6.

Figure 12:
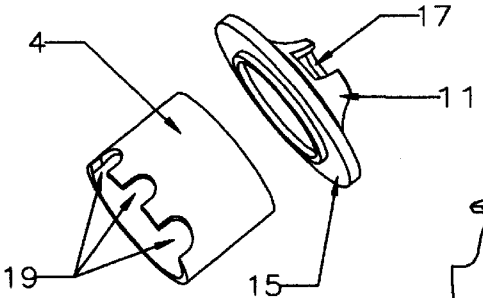
FIG. 12 is a front face perspective view of an alternate arrangement of the baffle/spacer element as shown in FIG. 2 and FIG. 3 where the spacer element is separate from the baffle element.
Figure 11:
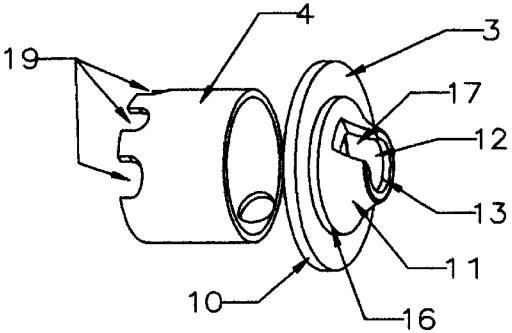
FIG. 11 is a rear face perspective view of an alternate arrangement of the baffle/spacer element as shown in FIG. 2 and FIG. 3 and where the spacer element is separate from the baffle element.

Coaxial spacer element 4, as shown in FIG. 2 and FIG. 3 as an integral part of baffle element 3, has at least one gas port 18 in the body and at least one notch 19 at the front edge of the coaxial spacer element. Although FIG. 2 and FIG. 3 show a plurality of notches 19, this is shown for illustrative purposes only and it should be understood that in practice at least one notch 19 is used. If the coaxial spacer element is separate from baffle element 3 as shown in FIG. 11 and FIG. 12, then at least one notch is provided at one edge of the coaxial spacer element 4.

Figure 4:
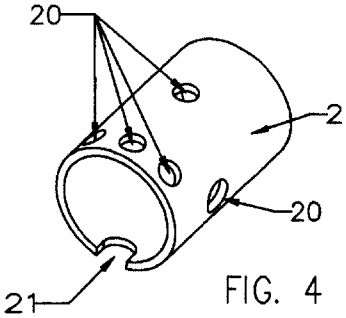
FIG. 4 is a front face perspective view of an initial spacer element that is part of the firearm sound suppressor shown in FIG. 1.
Figure 5:
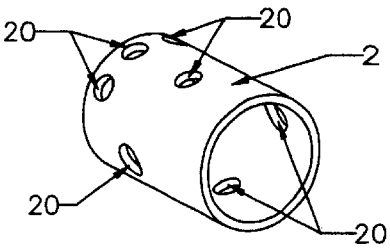
FIG. 5 is a rear face perspective view of an initial spacer element of FIG. 4.

The initial spacer element 2 as shown in FIG. 4 and FIG. 5 is a reduced diameter cylindrically shaped tube, although it may not be cylindrically shaped, with a larger diameter shoulder 23 at one end. This outer diameter of the shoulder is the same size as the internal dimension of said cylindrical housing, and it has at least one gas port 20 in the body and at least one notch 21 at an edge of the spacer. Although FIG. 9 and FIG. 10 show a plurality of gas ports 20 and a plurality of notches 21, it should be understood that this is shown for illustrative purposes only. In practice, at least one gas port 20 and at least one notch 21 is used. The size of reduced diameter cylindrical shaped tube 22 is less than the internal diameter of housing 1.

Figure 15:
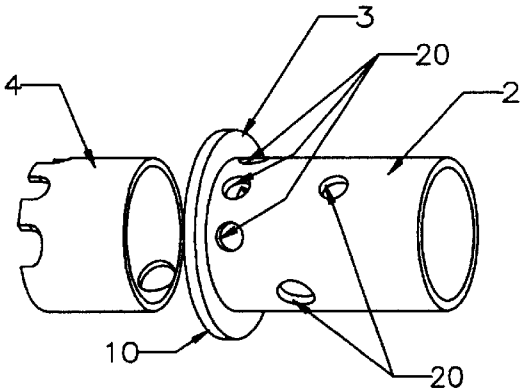
FIG. 15 is a rear face perspective of an alternate arrangement of baffle/spacer element as shown in FIG. 2 and FIG. 3 where the initial spacer element 2 is integral with baffle/spacer element 3.

The initial spacer element 2 as shown in FIG. 4 and FIG. 5 may be combined with baffle element 3 as shown in FIG. 2 and FIG. 3 to form a one-piece combination spacer/baffle/spacer element where said initial spacer element is integral with baffle element 3, as shown in FIG. 15.

Rear end cap 5 is shown with internal threads 30 which may mate with external threads on the end of a firearm barrel, or may mate with an adaptor that is detachably coupled to the end of a firearm barrel. The threaded entrance aperture 35 is shown for illustrative purposes only as one form of attachment to a firearm barrel, since a wide variety of known attachment means could be used to attach the sound suppressor to the firearm.

Front end cap 6 is provided with an exit aperture 40 for the exit of projectiles. Although rear end cap 5 and front end cap 6 are not shown with screw threads to allow secure attachment to housing 1, it should be understood that screw threads or other means such as welding may be used to secure attachment of rear end cap 5 and front end cap 6 to housing 1.

After the firearm is discharged, and the projectile passes through rear end cap 5 and into initial gas expansion chamber 9*a*, the gases flow forward and expand into the expansion chamber 9*a* and into expansion chamber 9*b* through gas port 20 and notch 21. Gases also flow forward through aperture 13 of the rearward protruding cone surface 11 of baffle element 3 and at the same time vent through elongated slot 17 onto the inner surface of the initial spacer element 2, creating an additional gas path and at the same time directing gases away from the axis or bore 42 of the suppressor through notch 21 and into expansion chamber 10. The external shape of the cone surface 11 aids in directing the gases away from the axis or bore 42 of the suppressor and through notch 21 and into expansion chamber 9*b*. The venting of gases through elongated slot 17 also creates some turbulence within expansion chamber 9*a*. The turbulence caused within expansion chamber 9*a*, coupled with the expansion of gases in expansion chamber 9*b*, causes the gases to take longer to exit the two initial gas expansion chambers 9*a* and 9*b*.

Once the gases from expansion chambers 9*a* and 9*b* have exited these expansion chambers and pass through aperture 13 and forward through opening 14, they expand into expansion chamber 7 and travel forward and expand outward into expansion chamber 8 through gas port 18 and notch 19. The diversion of the gases away from the axis or bore 42 is aided by the external shape of cone 11 and the gases flow forward and outward through notch 19 and into expansion chamber 8. Gases flow forward through aperture 13 and at the same time vent through elongated slot 17 and through notch 19 and also at the same time onto the inner surface of coaxial spacer 4, thus creating some turbulence within expansion chamber 7. The combined surface area of the coaxial spacer elements and the baffle elements provide a large surface area for the cooling of the expanding gases, thus aiding in reducing the gas flow rate by the transfer of thermal energy from the gases to the coaxial spacer elements and baffle elements.

The positions of baffle element 3 and coaxial spacer element 4 may be rotated with respect to the axis or bore 42 of the housing 1. In practice, it has been found that, depending upon the caliber of the host firearm that is to be suppressed, baffle element 3 and coaxial spacer element 4 may be subject to rotational positioning and this positioning results in the tuning of the sound suppressor to that particular caliber. This positioning also results in little or no significant detrimental deviation of the strike of the projectile, due to a balancing of the gas venting from the series of expansion chambers 7 into the series of expansion chambers 8.

As an example, it has been found that by positioning a plurality of baffle elements 3 and spacer elements 4 initially so that the elongated slot 17 is positioned at 6 o'clock position (when viewed from the rear of the suppressor), and then rotating a plurality of additional baffle elements 3 and spacer elements 4 by ninety degrees or more with respect to the previous position of elongated slot 17, the sound reduction is increased and the detrimental deviation of the strike of the projectile is minimized. Those skilled in the art will be able to determine exact positioning for maximum sound reduction and minimized deviation of the strike of the projectile.

A significant influence on the minimization of the detrimental deviation of the strike of the projectile is due to the varying of the size and position of gas port 18 and the size, shape and position of notch 19 on coaxial spacer element 4. By careful positioning and proper selection of the size of gas port 18 and the proper selection of the size, shape and position of notch 19, the flow of gases from within chamber 7 to chamber 8 is balanced throughout the suppressor. The external shape of cone 11 enhances a balanced flow of gases away from the axis or bore 42 and through gas port 18 and notch 19. The gases are vented from within chamber 7 into chamber 8 in a balanced flow and while elongated slot 17 creates some turbulence within chamber 7, this turbulence is created away from the axis or bore 42 and is on the underside of cone 11. The position of notch 19 in relation to elongated slot 17 means that the turbulence created by elongated slot 17 is directed away from the axis or bore 42 and through notch 19 into expansion chamber 8.

DETAILED DESCRIPTION OF A SECOND EMBODIMENT OF THE INVENTION

FIG. 6 shows a second embodiment of the sound suppressor that consists of a hollow cylindrical housing 1 with baffle elements 3 and coaxial spacer elements 4 forming a series of expansion chambers 7 and 8 between the baffle elements 3. A rear end cap 5 and a front end cap 6 is secured to the housing 1, either by screw threads which are not shown or by welding the end caps 5 and 6 to the housing 1.

An initial coaxial spacer element 2 is positioned between the rear end cap 5 and a baffle element 3 and this forms two initial gas expansion chambers 9*a* and 9*b*. Baffle element 3 consists of a flat plate 10 with an integral rearward protruding cone 11 with the apex of the conical surface pointing towards the muzzle of the firearm and the cone 11 having an internal conical surface 12 and a bore aperture 13 and cone 11 has an opening 14 on the front face 15 of the baffle element. An annular shoulder 16 is provided to allow for the initial coaxial spacer element 2 and coaxial spacer element 4 to interface with the baffle element 3 and to provide alignment between said initial coaxial spacer element 2.

Figure 7:
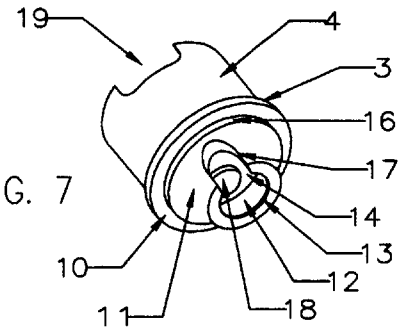
FIG. 7 is a rear face perspective view of an alternate baffle/spacer element that is part of the firearm sound suppressor shown in FIG. 6.

The rearward protruding cone 11 has a bore aperture 13 and bore aperture 13 is provided with an elongated slot 17. Elongated slot 17 is shown in FIG. 7 at approximately the 11 o'clock position for illustrative purposes only. In practice, the position of elongated slot 17 varies according to the caliber of the host firearm and for maximum sound reduction.

Figure 8:
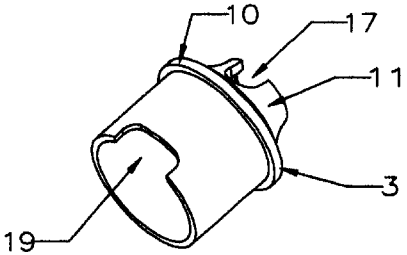
FIG. 8 is a front face perspective front view of an alternate baffle/spacer element of FIG. 7.
Figure 14:
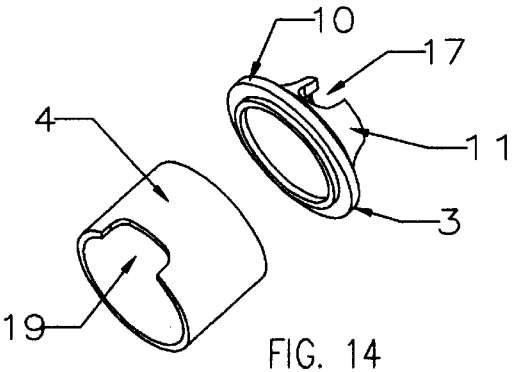
FIG. 14 is a front face perspective view of an alternate arrangement of the baffle/spacer element as shown in FIG. 7 and FIG. 8 where the spacer element is separate from the baffle element.
Figure 13:
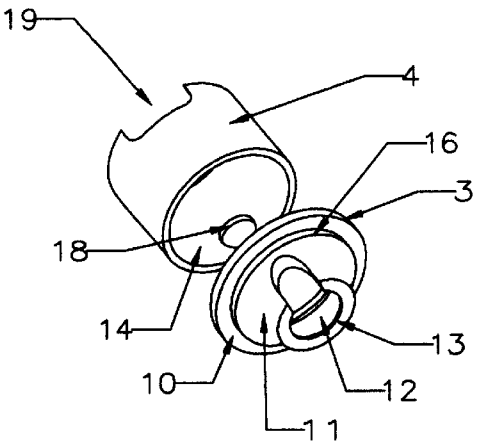
FIG. 13 is a rear face perspective view of an alternate arrangement of the baffle/spacer element as shown in FIG. 7 and FIG. 8 where the spacer element is separate from the baffle element.

Coaxial spacer element 4 may be combined with baffle element 3 as shown in FIG. 7 and FIG. 8 to form a combined baffle/spacer element where the coaxial spacer element 4 is an integral part of the baffle element 3 and protrudes forward from the flat plate 10. FIG. 7 and FIG. 8 show the spacer element 4 as a part of baffle element 3 protruding forward of the flat plate 10 for illustrative purposes only and spacer element 4 may protrude rearward or forward of the flat plate 10. The spacer element 4 may be separate from baffle element 3 and if baffle element 3 is not combined with coaxial spacer element 4, as shown in FIG. 13 and FIG. 14 where a separate baffle and spacer element are shown, an additional annular shoulder (not shown) may be provided on the front face 15 of baffle element 3 to provide an interface between baffle 3 and coaxial spacer element 4 or said separate spacer element 4 may simply use annular shoulder element 16 for alignment and interface purposes.

If the baffle 3 and spacer element 4 are integral, the coaxial spacer element fits over annular shoulder 16 of the next baffle element 3 downstream from previous the baffle element 3, thus creating expansion chambers 7 and 8 as shown in FIG. 6. If the baffle 3 and spacer element 4 are separate, the coaxial spacer fits over annular shoulder 16 of the next baffle element 3 downstream from the previous baffle element 3 and abuts up against the front face 15 of the previous baffle element 4 creating expansion chambers 7 and 8 in the same manner as in FIG. 6.

Coaxial spacer element 4, as shown in FIG. 7 and FIG. 8 as an integral part of baffle element 3, has at least one gas port 18 in the body and at least one notch 19 at the front edge of the coaxial spacer element. If the coaxial spacer element is separate from baffle element 3 as shown in FIG. 13 and FIG. 14, then at least one notch is provided at one edge of the coaxial spacer element 4.

The initial spacer element 2 as shown in FIG. 9 and FIG. 10 is an reduced diameter cylindrically shaped tube 22 although it may not be cylindrical shaped, with a larger diameter shoulder 23 at one end, said outer diameter of shoulder being the same size as the internal dimension of said cylindrical housing, and has at least one gas port 20 in the body and at least one notch 21 at an edge of the spacer. Although FIG. 9 and FIG. 10 show a plurality of gas ports 20 and a plurality of notches 21 it should be understood that this is shown for illustrative purposes only and in practice at least one gas port 20 and at least one notch 21 is used. The size of reduced diameter cylindrically shaped tube 22 is less than the internal diameter of housing 1.

Figure 16:
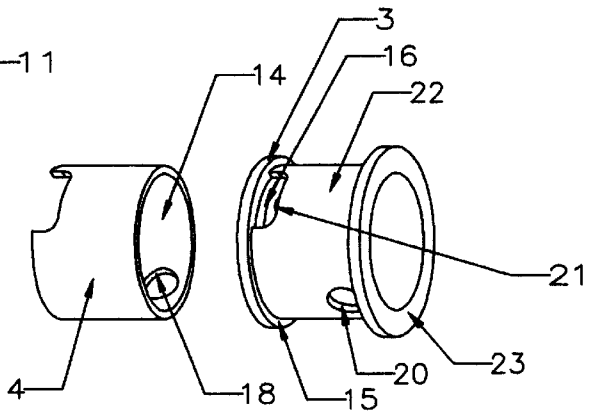
FIG. 16 is a rear face perspective of an alternate arrangement of baffle/spacer element as shown in FIG. 7 and FIG. 8 where the initial spacer element 2 is integral with baffle/spacer element 3.

The initial spacer element 2 as shown in FIG. 7 and FIG. 8 may be combined with baffle element 3 as shown in FIG. 2 and FIG. 3 to form a one-piece combination spacer/baffle/spacer element where said initial spacer element is integral with baffle element 3, as shown in FIG. 16.

Rear end cap 5 as shown in FIG. 6 has with internal threads 30 which may mate with external threads on the end of a firearm barrel, or may mate with an adaptor that is detachably coupled to the end of a firearm barrel. The threaded entrance aperture 35 is shown for illustrative purposes only as one form of attachment to a firearm barrel, since a wide variety of known attachment means could be used to attach the sound suppressor to the firearm.

Front end cap 6 as shown in FIG. 6 is provided with an exit aperture 40 for the exit of projectiles and although rear end cap 5 and front end cap 6 are not shown with screw threads to allow secure attachment to housing 1, it should be understood that screw threads or other means such as welding may be used to secure attachment of rear end cap 5 and front end cap 6 to housing 1.

After the firearm is discharged, and the projectile passes through rear end cap 5 and into initial gas expansion chamber 9*a*, the gases flow forward and expand into the expansion chamber 9*a* and into expansion chamber 9*b* through gas port 20 and notch 21. Gases also flow forward through aperture 13 of the rearward protruding cone surface 11 of baffle element 3 and at the same time vent through elongated slot 17 onto the inner surface of the initial spacer element 2, creating an additional gas path and at the same time directing gases away from the axis or bore 42 of the suppressor through notch 21 and into expansion chamber 9*b*. The external shape of the cone surface 11 aids in directing the gases away from the axis or bore 42 of the suppressor and through notch 21 and into expansion chamber 9*b*. The venting of gases through elongated slot 17 also creates some turbulence within expansion chamber 9*a*. The turbulence caused within expansion chamber 9*a*, coupled with the expansion of gases in expansion chamber 9*b*, causes the gases to take longer to exit the two initial gas expansion chambers 9*a* and 9*b*.

Once the gases from expansion chambers 9*a* and 9*b* have exited these expansion chambers and pass through aperture 13 and forward through opening 14, they expand into expansion chamber 7 and travel forward and expand outward into expansion chamber 8 through gas port 18 and notch 19. The diversion of the gases away from the axis or bore 42 is aided by the external shape of cone 11 and the gases flow forward and outward through notch 19 and into expansion chamber 8. Gases flow forward through aperture 13 and at the same time vent through elongated slot 17 and through notch 19 and also at the same time onto the inner surface of coaxial spacer 4, thus creating some turbulence within expansion chamber 7. The combined surface area of the coaxial spacer elements and the baffle elements provide a large surface area for the cooling of the expanding gases, thus aiding in reducing the gas flow rate by the transfer of thermal energy from the gases to the coaxial spacer elements and baffle elements.

The positions of baffle element 3 and coaxial spacer element 4 may be rotated with respect to the axis or bore 42 of the housing 1. In practice, it has been found that, depending upon the caliber of the host firearm that is to be suppressed, baffle element 3 and coaxial spacer element 4 may be subject to rotational positioning, and this positioning results in the tuning of the sound suppressor to that particular caliber. This positioning also results in little or no significant detrimental deviation of the strike of the projectile, due to a balancing of the gas venting from the series of expansion chambers 7 into the series of expansion chambers 8. This minimizes the turbulence in the bullet path inside the sound suppressor and thereby enhances accuracy of the suppressed firearm.

As an example, it has been found that by positioning a plurality of baffle elements 3 and spacer elements 4 initially so that the elongated slot 17 is positioned at 6 o'clock position (when viewed from the rear of the suppressor), and then rotating a plurality of additional baffle elements 3 and spacer elements 4 by ninety degrees or more with respect to the previous position of elongated slot 17, the sound reduction is increased and the detrimental deviation of the strike of the projectile is minimized. Those skilled in the art will be able to determine exact positioning for maximum sound reduction and minimized deviation of the strike of the projectile.

A significant influence on the minimization of the detrimental deviation of the strike of the projectile is due to the varying of the size and position of gas port 18 and the size, shape and position of notch 19 on coaxial spacer element 4. By careful positioning and proper selection of the size of gas port 18 and the proper selection of the size, shape and position of notch 19, the flow of gases from within chamber 7 to chamber 8 is balanced throughout the suppressor. The external shape of cone 11 enhances a balanced flow of gases away from the axis or bore 42 and through gas port 18 and notch 19. The gases are vented from within chamber 7 into chamber 8 in a balanced flow. While elongated slot 17 creates some turbulence within chamber 7, this turbulence is created away from the axis or bore 42 and is on the underside of cone 11. The position of notch 19 in relation to elongated slot 17 means that the turbulence created by elongated slot 17 is directed away from the axis or bore 42 and through notch 19 into expansion chamber 8. This minimizes the turbulence in the bullet path inside the sound suppressor and thereby enhances accuracy of the suppressed firearm.

It has been found that when using the baffle element 3 and spacer element 4 as shown in FIG. 6, FIG. 7, FIG. 8, FIG. 13 and FIG. 14, that use of a fluid additive to achieve higher levels of sound reduction is not necessary. It has been found that the sound reduction levels achieved through the use of baffle element 3 and spacer element 4 as shown in FIG. 6, FIG. 7, FIG. 8, FIG. 13 and FIG. 14, are comparable to or even greater than a prior art sound suppressor of a similar given size which uses fluid additives to achieve higher sound reduction levels.

Many prior art sound suppressors work well with only one caliber of ammunition. As an example, one type of sound suppressor device may work well with 9 mm caliber ammunition, but it will not work well with 7.62 mm NATO caliber ammunition. The gas pressure levels of these examples of ammunition are quite different, and this affects the performance of the sound suppressor device. This has meant that a particular baffle and spacer design has to be, in some cases, extensively modified so that good performance is achieved with different caliber firearms. A major benefit of this invention is that it can be used with a wide variety of calibers of ammunition with minimal changes to the design of the sound suppressor. The sound suppressor of this invention will function from 0.17 caliber ammunition through to .50 caliber ammunition, although some dimensional changes are necessary to allow for changes in caliber of ammunition and different sized barrels.

Another major benefit is that by rotating the position of the baffle and spacer elements, the sound suppressor can be tuned for maximum sound reduction for a given caliber of ammunition. Yet another benefit is that the rotation of the baffle and spacer elements also aid in the design of a sound suppressor for a particular caliber that produces little or no significant detrimental deviation of the strike of the projectile, due to a balancing of the gas venting from the series of expansion chambers 7 into the series of expansion chambers 8.

A third major benefit of this invention is that the sound reduction levels achieved using the baffle and spacer elements described herein are much greater than other prior art sound suppressors. While other prior art sound suppressors have required the use of a fluid additive to achieve comparable sound reduction levels, such use of a fluid additive is not necessary with this invention.

Yet another benefit is that, while the invention is an effective sound suppressor for a firearm, it is also an effective muzzle flash suppressor.

While the sound suppressor as depicted and described herein is attached to a firearm barrel, it is possible to have a sound suppressor of the invention as an integral part of a firearm barrel or be mounted or attached in other means.

While the invention has been shown and described with reference to certain specific preferred embodiments, modification may now suggest itself to those skilled in the art. Such modifications and various changes in form and detail may be made herein without departing from the spirit and scope of the invention. Accordingly, it is understood that the invention will be limited only by the appended claims.

What is claimed is:

1. A sound suppressor for a firearm, comprising:

a cylindrical housing having a rear end cap attached to the housing and having means for mounting the sound suppressor to the muzzle of a firearm; a front end cap attached to the cylindrical housing and having a centrally positioned aperture;

a baffle element positioned within the cylindrical housing and between the rear end cap and the front end cap, with the baffle element comprising a flat plate with an integral rearward-protruding cone, with the cone having an entrance aperture and an exit aperture, with the exit aperture being positioned on the front face of the flat plate, with the cone having an elongated aperture that extends from the entrance aperture of the cone toward the flat plate;

an initial coaxial spacer element positioned between the rear end cap and the baffle element, the initial coaxial spacer element being smaller than an inner diameter of the cylindrical housing, and an outer dimension of the baffle element, the initial coaxial spacer element having at least one gas port and at least one notch at an edge of the spacer element, and whereby the initial coaxial spacer element is positioned over the cone portion of the baffle element, whereby an outer chamber is defined between the baffle element and the rear end cap and an outer surface of the initial coaxial spacer element, whereby an inner chamber is defined between the baffle element and the rear end cap and an inner surface of the initial coaxial spacer element; and a coaxial spacer element positioned between the front end cap and the baffle element, the coaxial spacer element being smaller than an inner dimension of the cylindrical housing and an outer dimension of the baffle element, the coaxial spacer element having at least one gas port and at least one notch at an edge of the coaxial spacer element, whereby an outer chamber is defined between the baffle element and the front end cap and an outer surface of the coaxial spacer element, whereby an inner chamber is defined between the baffle element and the front end cap and an inner surface of the coaxial spacer element.

2. A sound suppressor as claimed in claim 1, including:

a plurality of the baffle elements positioned within the cylindrical housing between the rear end cap and front end cap in a spaced relationship; and a plurality of coaxial spacer elements positioned within the cylindrical housing between the baffle elements where the spacer elements fit over the cone portion of the baffle elements and between the baffle elements, whereby the spacer elements define a series of outer and inner chambers between the baffle elements and whereby the outer chambers are defined between the baffle elements and the outer surfaces of the coaxial spacer elements, and whereby the series of inner chambers are defined between the baffle elements and the inner surfaces of the coaxial spacer elements.

3. A sound suppressor for a firearm, comprising:

a cylindrical housing having a rear end cap attached to the housing and having means for mounting the sound suppressor to the muzzle of a firearm; a front end cap attached to the cylindrical housing and having a centrally positioned aperture;

a combined baffle/spacer element positioned within the cylindrical housing and between the rear end cap and the front end cap, with the combined baffle/spacer element comprising a baffle element which is an integral part of the combined baffle/spacer element and the baffle element part comprising a flat plate with an integral rearward-protruding cone, with the cone having an entrance aperture and an exit aperture, with the exit aperture being positioned on the front face of the flat plate, with the cone having an elongated aperture that extends from the entrance aperture of the cone toward the flat plate, a coaxial spacer element positioned between the front end cap and the baffle element, where the coaxial spacer element is an integral part of the combined baffle/spacer element, the coaxial spacer element part being smaller than an inner dimension of the cylindrical housing and an outer dimension of the baffle element part, the coaxial spacer element part having at least one gas port and at least one notch at an edge of the coaxial spacer element part, whereby an outer and an inner chamber are defined between the baffle element part and the front end cap and the coaxial spacer element part, and whereby an outer chamber is defined between the baffle element part and the front end cap and the outer surface of the coaxial spacer element part; and an inner chamber is defined between the baffle element part and the front end cap and the inner surface of the coaxial spacer element part; and an initial coaxial spacer element positioned between the rear end cap and the baffle element, the initial coaxial spacer element being smaller than an inner diameter of the cylindrical housing, and an outer dimension of the baffle element part, the initial coaxial spacer element having at least one gas port and at least one notch at an edge of the spacer element, and whereby the initial coaxial spacer element is positioned over the cone portion of the baffle element part, whereby an outer chamber is defined between the baffle element part and the rear end cap and an outer surface of the initial coaxial spacer element, whereby an inner chamber is defined between the baffle element part and the rear end cap and an inner surface of the initial coaxial spacer element.

4. A sound suppressor for a firearm, as claimed in claim 3, including:

a plurality of combined baffle/spacer elements positioned within the cylindrical housing and between the initial coaxial spacer element and the front end cap, whereby the plurality of combined baffle/spacer elements define a series of outer and inner chambers between the combined baffle/spacer elements, and whereby the series of outer chambers are defined between the baffle element parts and the outer surfaces of the coaxial spacer element parts of combined baffle/spacer elements, and the series of inner chambers is defined between the baffle element parts and the inner surfaces of the coaxial spacer element parts of combined baffle/spacer elements; and whereby outer and inner chambers are defined between the combined baffle/spacer element and the front end cap, and whereby the outer chamber is defined between the baffle element part and the outer surface of the coaxial spacer element part of the combined baffle/spacer element and front end cap, and whereby the inner chamber is defined between the baffle element part and the inner surface of the coaxial spacer element part of the combined baffle/spacer element.

5. A sound suppressor for a firearm, comprising:

a cylindrical housing having a rear end cap attached to the housing and having means for mounting the sound suppressor to the muzzle of a firearm; a front end cap attached to the cylindrical housing and having a centrally positioned aperture; and a combined initial coaxial spacer/baffle/spacer element positioned within the cylindrical housing and between the rear end cap and the front end cap and the combined initial coaxial spacer/baffle/spacer element comprising a baffle element that is an integral part of the combined initial coaxial spacer/baffle/spacer element and the baffle element part comprising a flat plate with an integral rearward-protruding cone, with the cone having an entrance aperture and an exit aperture, with the exit aperture being positioned on the front face of the flat plate, with the cone having an elongated aperture that extends from the entrance aperture of the cone toward the flat plate, a coaxial spacer element positioned between the front end cap and the baffle element, where the coaxial spacer element is an integral part of the combined initial coaxial spacer/baffle/spacer element, the coaxial spacer element part being smaller than an inner dimension of the cylindrical housing and an outer dimension of the baffle element part, the coaxial spacer element part having at least one gas port and at least one notch at an edge of the coaxial spacer element, whereby an outer chamber is defined between the baffle element part and the front end cap and an outer surface of the coaxial spacer element part, whereby an inner chamber is defined between the baffle element part and the front end cap and an inner surface of the coaxial spacer element part, and whereby an initial coaxial spacer element is an integral part of the initial coaxial spacer/baffle/spacer element, the initial coaxial spacer element part being smaller than an inner diameter of the cylindrical housing, and an outer dimension of the baffle element part, the initial coaxial spacer element part having at least one gas port and at least one notch at an edge of the spacer element, and whereby the initial coaxial spacer element part is positioned over the cone portion of the baffle element part, whereby an outer chamber is defined between the baffle element part and the rear end cap and an outer surface of the initial coaxial spacer element part, and whereby an inner chamber is defined between the baffle element part and the rear end cap and an inner surface of the initial coaxial spacer element part.

6. A sound suppressor, as claimed for in claim 5, including:

at least one combined baffle/spacer element positioned within the cylindrical housing and between the combined initial coaxial spacer/baffle/spacer element and the front end cap and the baffle element comprising a flat plate with an integral rearward-protruding cone, with the cone having an entrance aperture and an exit aperture, with the exit aperture being positioned on the front face of the flat plate, with the cone having an elongated aperture that extends from the entrance aperture of the cone toward the flat plate, a coaxial spacer element positioned between the front end cap and the baffle element, where the coaxial spacer element is an integral part of the baffle element, the coaxial spacer element part being smaller than an inner dimension of the cylindrical housing and an outer dimension of the baffle element, the coaxial spacer element part having at least one gas port and at least one notch at an edge of the coaxial spacer element part, whereby an outer and an inner chamber are defined between the baffle element and the front end cap and the coaxial spacer element part, and whereby an outer chamber is defined between the baffle element and the front end cap and the outer surface of the coaxial spacer element part; and an inner chamber is defined between the baffle element and the front end cap and the inner surface of the coaxial spacer element part.

7. A sound suppressor as claimed for in claim 6, including:

a plurality of combined baffle/spacer elements positioned within the cylindrical housing and between the initial coaxial spacer element and the front end cap, whereby the plurality of combined baffle/spacer elements define a series of outer and inner chambers between the combined baffle/spacer elements, and whereby the series of outer chambers are defined between the baffle element parts and the outer surfaces of the coaxial spacer element parts of combined baffle/spacer elements, and the series of inner chambers is defined between the baffle element parts and the inner surfaces of the coaxial spacer element parts of combined baffle/spacer elements; and whereby outer and inner chambers are defined between the combined baffle/spacer element and the front end cap, and whereby the outer chamber is defined between the baffle element part and the outer surface of the coaxial spacer element part of the combined baffle/spacer element and front end cap, and whereby the inner chamber is defined between the baffle element part and the inner surface of the coaxial spacer element part of the combined baffle/spacer element.

8. A sound suppressor as claimed for in claim 1, wherein the initial coaxial spacer element comprises a reduced diameter cylindrically shaped tube with a larger diameter shoulder at the entrance end of the initial coaxial spacer element, whereby the outer diameter of the shoulder is the same size as the internal dimension of the cylindrical housing, and has at least one gas port in the body and at least one notch at an edge of the spacer.

9. A sound suppressor as claimed for in claim 2 wherein the initial coaxial spacer element comprises a reduced diameter cylindrically shaped tube with a larger diameter shoulder at the entrance end of the initial coaxial spacer element, whereby the outer diameter of the shoulder is the same size as the internal dimension of the cylindrical housing, and has at least one gas port in the body and at least one notch at an edge of the spacer.

10. A sound suppressor as claimed for in claim 3, wherein the initial coaxial spacer element comprises a reduced diameter cylindrically shaped tube with a larger diameter shoulder at the entrance end of the initial coaxial spacer element, whereby the outer diameter of the shoulder is the same size as the internal dimension of the cylindrical housing, and has at least one gas port in the body and at least one notch at an edge of the spacer.

11. A sound suppressor as claimed for in claim 4, wherein the initial coaxial spacer element comprises a reduced diameter cylindrically shaped tube with a larger diameter shoulder at the entrance end of the initial coaxial spacer element, whereby the outer diameter of the shoulder is the same size as the internal dimension of the cylindrical housing, and has at least one gas port in the body and at least one notch at an edge of the spacer.

12. A sound suppressor as claimed for in claim 5, wherein the initial coaxial spacer element comprises a reduced diameter cylindrically shaped tube with a larger diameter shoulder at the entrance end of the initial coaxial spacer element, whereby the outer diameter of the shoulder is the same size as the internal dimension of the cylindrical housing, and has at least one gas port in the body and at least one notch at an edge of the spacer.

13. A sound suppressor as claimed for in claim 6, wherein the initial coaxial spacer element part of the combined initial coaxial spacer/baffle/spacer element comprises a reduced diameter cylindrically shaped tube with a larger diameter shoulder at the entrance end of the initial coaxial spacer element part, whereby the outer diameter of the shoulder is the same size as the internal dimension of the cylindrical housing and has at least one gas port in the body of the combined initial coaxial spacer part and at least one notch at an edge of the initial coaxial spacer element part of the combined initial coaxial spacer/baffle/spacer element.

14. A sound suppressor as claimed for in claim 7, wherein the initial coaxial spacer element part of the combined initial coaxial spacer/baffle/spacer element comprises a reduced diameter cylindrically shaped tube with a larger diameter shoulder at the entrance end of the initial coaxial spacer element part, whereby the outer diameter of the shoulder is the same size as the internal dimension of the cylindrical housing and has at least one gas port in the body of the combined initial coaxial spacer part and at least one notch at an edge of the initial coaxial spacer element part of the combined initial coaxial spacer/baffle/spacer element.

* * * * *